US011464321B1

(12) United States Patent
Phillips

(10) Patent No.: US 11,464,321 B1
(45) Date of Patent: Oct. 11, 2022

(54) METHOD OF SUPPORTING AN IMPLEMENT IN A WORKING POSITION ON A HUMAN LIMB

(71) Applicant: Wendy Phillips, Mooresville, NC (US)

(72) Inventor: Wendy Phillips, Mooresville, NC (US)

( * ) Notice: Subject to any disclaimer, the term of this patent is extended or adjusted under 35 U.S.C. 154(b) by 0 days.

(21) Appl. No.: 17/360,141

(22) Filed: Jun. 28, 2021

(51) Int. Cl.
*A47G 21/08* (2006.01)
*A45F 5/00* (2006.01)

(52) U.S. Cl.
CPC ..... *A45F 5/00* (2013.01); *A45F 2005/008* (2013.01); *A47G 21/08* (2013.01)

(58) Field of Classification Search
CPC . A47G 21/08; B43L 15/00; A61F 4/00; A61F 5/0118; A61F 2/588; A61F 13/104; A61F 13/107; A45F 5/11; A45F 2005/008; A45F 2003/006; F16M 13/04
USPC ..... 224/267, 217–219
See application file for complete search history.

(56) References Cited

U.S. PATENT DOCUMENTS 706,141 A * 8/1902 Wirt ..... B43K 5/18 401/241
734,563 A * 7/1903 Kegrize ..... B43K 5/18 401/242
1,336,432 A * 4/1920 Henry ..... B43L 15/00 15/443
2,501,552 A * 3/1950 Thompson ..... B43L 15/00 401/8
2,866,440 A * 12/1958 Green ..... B43L 15/00 15/443
5,713,836 A * 2/1998 O'keefe ..... A61F 5/05858 602/5
6,079,758 A * 6/2000 Romero ..... A61F 4/00 30/298
6,527,464 B2 * 3/2003 Lee ..... B43K 23/012 401/6
9,913,525 B2 * 3/2018 Mine ..... H04B 1/385
2006/0088361 A1 * 4/2006 Nakhaie ..... B43L 15/00 401/48
2014/0035884 A1 * 2/2014 Oh ..... G06F 3/03545 345/179
2016/0344907 A1 * 11/2016 Park ..... F16M 13/04

* cited by examiner

*Primary Examiner* — Adam J Waggenspack
(74) *Attorney, Agent, or Firm* — Wood, Phillips, Katz, Clark & Mortimer

(57) ABSTRACT

A method of supporting an implement in at least one working position on at least one limb of a person including the steps of: obtaining a securing assembly comprising an elongate body portion formable into different maintainable shapes; forming the elongate body portion with respect to a part of the at least one limb to thereby cause the securing assembly to be maintained on the at least one limb; and operatively engaging the securing assembly and implement to thereby cause the implement to be supported in the one working position, whereby with the implement supported in the one working position, the person can move his/her at least one limb to cause the implement to perform a task.

17 Claims, 5 Drawing Sheets

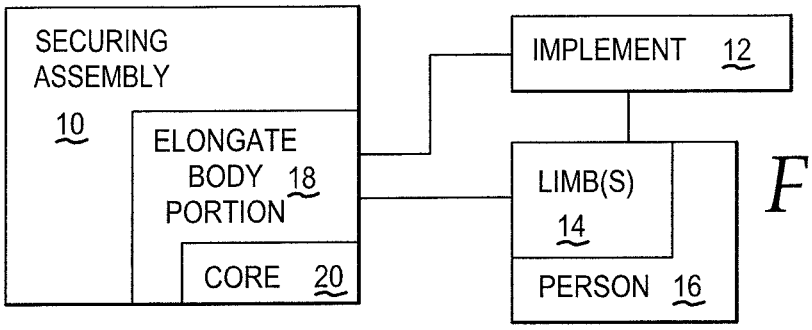
Fig. 1
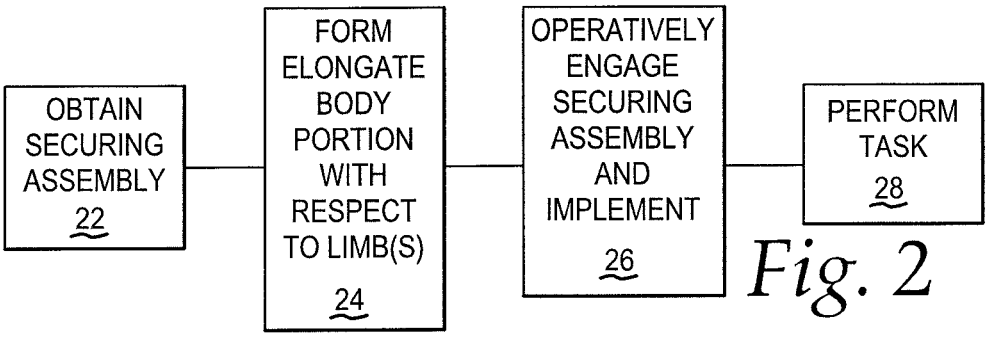
Fig. 2
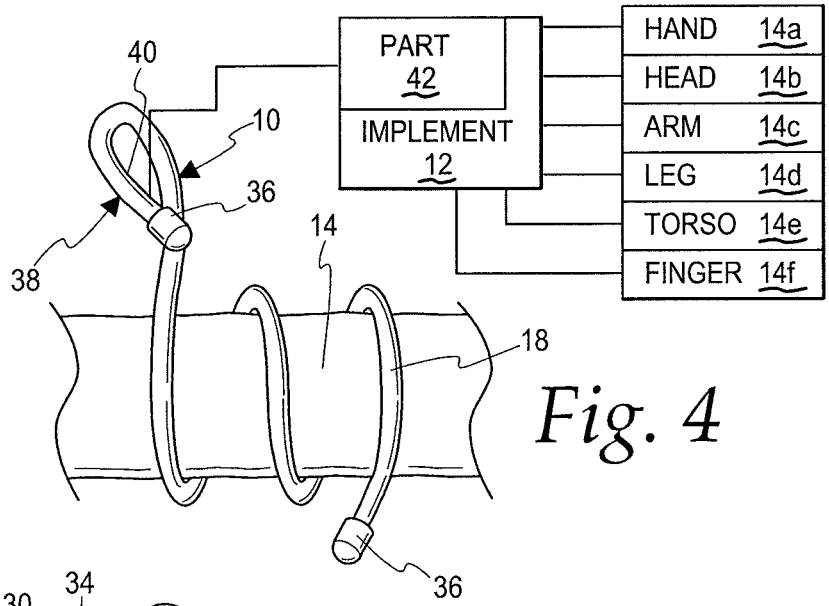
Fig. 4
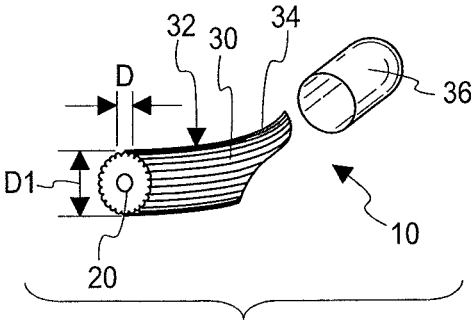
Fig. 3
Fig. 5
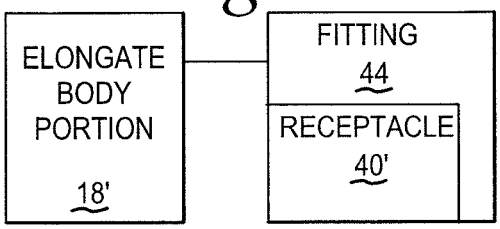

METHOD OF SUPPORTING AN IMPLEMENT IN A WORKING POSITION ON A HUMAN LIMB

BACKGROUND OF THE INVENTION

FIELD OF THE INVENTION

This invention relates to portable implements to be held and manipulated by a person to perform various tasks and, more particularly, to a method for supporting a portable implement in a working position on a human limb.

BACKGROUND ART

A range of portable implements are used by individuals throughout daily routines, in different categories ranging from hygiene to work functions. One specific example of such an implement is one used to facilitate consumption of food. Knives, forks, and spoons are conventionally made with elongate handles that can be conveniently grasped by coordinated movement between the fingers and palm of a user's hand.

Various conditions may compromise a person's ability to handle such implements without assistance. Arthritis may make it difficult or impossible for a person to produce a necessary grasping force. Any irregularity in the form of the hand, be it due to an amputation or any other condition, whether natural or acquired, may likewise limit a person's ability to use the above implements and other portable implements.

Limitations of the human hand have prompted the development of a number of devices that assist implement manipulation. Enlarged bodies on which implements can be held may be used to provide more readily graspable surfaces, as for those hampered by arthritis.

In an alternative form, a body that accepts the implement is equipped with a strap which allows the fingers and/or another part of the hand to be directed through a loop shape to support the body with the associated implement.

Many other forms of assist devices exist. These existing devices offer a considerable advantage to persons needing some assistance in gripping implements. However, they have a number of limitations.

First of all, most of these devices are designed to accommodate a single type of handle on an implement and to maintain that implement in primarily a single orientation. A person may wish to change the working location or orientation of the implement, particularly with activities such as cleaning teeth, during which a toothbrush is desirably held in many different orientations.

Further, this type of assist device is generally made for a single type of handle, which limits its ability to accommodate differently configured implements.

As a result, a person may have to keep on hand many different devices to be able to handle different types of implements and similarly functioning implements with different handles.

Such devices may also be limited to use on a single limb, which may necessitate the keeping on hand multiple such devices for different limbs.

Still further, generally the above-type devices may engage the person's limb over a relatively small area. This may produce discomfort and limit the ability to stabilize the implement to a desired extent in use.

The industry continues to seek out apparatus and methods of using the same that offer affordable solutions with versatility and, most significantly, allow comfortable implement use by persons regardless of the issues associated with a particular limb through which the implement is manipulated.

SUMMARY OF THE INVENTION

In one form, the invention is directed to a method of supporting an implement in at least one working position on at least one limb of a person. The method includes the steps of: obtaining a securing assembly having an elongate body portion configured to be formed into different maintainable shapes; forming the elongate body portion with respect to a part of the at least one limb to thereby cause the securing assembly to be maintained on the at least one limb; and operative engaging the securing assembly and implement to thereby cause the implement to be supported in the one working position, whereby with the implement supported in the one working position, the person can move his/her at least one limb to cause the implement to perform a task.

In one form, the elongate body portion on the securing assembly has a shape retentive bendable core. A cushioning layer surrounds the shape retentive bendable core.

In one form, the securing assembly has a receptacle into which a part of the implement extends with the implement and securing assembly operatively engaged.

In one form, a part of the implement is captured between the elongate body portion and the person's at least one limb with the implement and securing assembly operative engaged.

In one form, the at least one limb is at least part of an arm of the person.

In one form, the at least one limb is at least a part of a hand on the arm of the person.

In one form, with the implement supported in the one working position, the elongate body portion wraps through at least 360° around a part of the at least one limb.

In one form, with the implement supported in the one working position, the elongate body portion wraps through at least 540° around a part of the at least one limb.

In one form, the step of forming the elongate body portion against the part of the at least one limb involves bending the elongate body portion before operatively engaging the securing assembly and implement.

In one form, with the implement supported in the one working position, a leading portion of the implement projects in cantilever fashion away from the securing assembly.

In one form, with the implement supported in the one working position, a leading portion of the implement projects in cantilever fashion away from a connector on the securing assembly.

In one form, the connector on the securing assembly defines a receptacle for a part of the implement.

In one form, the step of operatively engaging the securing assembly and implement involves causing the part of the implement to become wedged in the receptacle for the part of the implement.

In one form, the implement has a working end that performs as one of: a) a knife; b) a fork; c) a spoon; d) a brush; and e) a pointer.

In one form, the at least one limb is part of a leg.

In one form, the at least one limb is a head.

In one form, the connector on the securing assembly engages a part of the implement to maintain the implement in an operative position with respect to the securing assembly independently of the at least one limb.

In one form, the connector on the securing assembly cooperates with at least one connector on the implement to maintain the implement in an operative position with respect to the securing assembly independently of the at least one limb.

In one form, the implement is placed in the operative position with respect to the securing assembly before forming the elongate body portion by bending the elongate body portion against the part of the at least one limb.

In one form, the shape retentive bendable core is made from metal.

BRIEF DESCRIPTION OF THE DRAWINGS

FIG. 1 is a schematic representation of a securing assembly, according to the invention, used to maintain a portable implement in a working position on at least one of a person's limbs;

FIG. 2 is a schematic representation of a method of supporting an implement in a working position on the at least one limb of a person, utilizing a system as in FIG. 1;

FIG. 3 is a fragmentary, exploded, perspective view of an elongate body portion on the securing assembly;

FIG. 4 is a fragmentary, partially schematic, representation of one form of an operatively engaged security assembly and implement, with the implement supported in a working position on a person's limb;

FIG. 5 is a schematic representation of a modified form of elongate body portion with a fitting thereon to receive a part of an implement;

DETAILED DESCRIPTION OF THE PREFERRED EMBODIMENT

Figure 6:
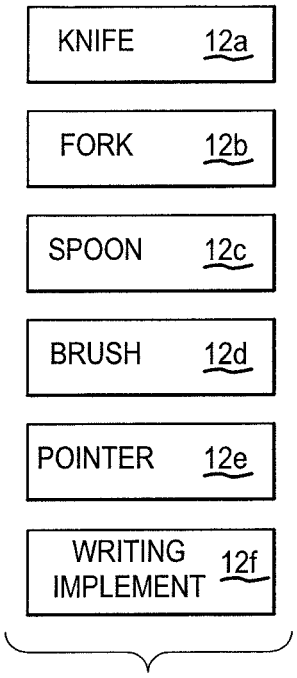
FIG. 6 is a schematic representation of different representative forms of implements usable with the present invention.

In FIG. 1, a schematic representation of a securing assembly, according to the present invention, is shown at 10. The securing assembly is operatively engageable with an implement, shown at 12, to thereby cause the implement to be supported in at least one working position with respect to at least one limb of a person, with the limb(s) also shown schematically in FIG. 1 at 14 on a person 16. The securing assembly 10 has an elongate body portion 18 configured to be formed into different maintainable shapes.

The schematic depiction in FIG. 1 is intended to encompass specific forms of implements 12, securing assemblies 10, and limbs 14, as set forth below, and virtually an unlimited number of variations of those securing assemblies 10 and implements 12 that can be used on virtually any one or more limbs 14 on a human body.

For example, the implement 12 may be any portable implement that can be controlled by at least one human limb 14 to perform a task. As just examples, the implement 12 may be in a form to assist eating—such as a knife, fork, or spoon. Alternatively, the implement 12 might be a type of mechanical tool or a device usable as to operate a touch screen on an electronic device, depress a key, etc. As noted, there is virtually no limitation as to the form of the implement 12 other than it is a type that is controllable by the person 16, while in at least one working position on one or more of the person's limb 14, by moving at least one of the limbs.

With respect to the limb 14, it may be any movable part of the human body. For purposes of this disclosure, the torso itself is considered to be a limb on which an implement 12 can be placed in at least one working position whereupon movement of the torso causes the implement 12 to perform a task. For purposes of this disclosure, the person's head is also considered to be a limb 14, as are all other body parts commonly characterized as a "limb".

The securing assembly 10 may also take virtually an unlimited number of different forms, with a likewise unlimited number of different potential forms of the elongate body portion 18 contemplated. The elongate body portion 18 is configured to be formed into different maintainable shapes by the application of a mechanical force. Typically, the forming into different maintainable shapes is effected by bending the elongate body portion 18.

The ability to maintain shapes is in one preferred form accomplished by providing the elongate body portion 16 with an elongate core 20. The core 20 may be made from a malleable material that upon being deformed will maintain the deformed shape without the continued application of the force that effected reconfiguration. For example, commonly metal wire—solid and braided—has this capability.

The core 20 can be made from a single piece or multiple pieces. As an alternative form, a hinge-type structure may be incorporated to allow different shapes to be produced and maintained in accordance with the teachings set forth herein.

The core 20 itself may make up the elongate body portion 18. In one preferred form, as described in detail below, a cushion layer surrounds the core for purposes of user comfort and to make the elongate body portion less prone to sliding along a limb surface, With the structure as depicted schematically in FIG. 1, a method of supporting an implement in at least one working position on at least one limb of a person can be performed, as shown in flow diagram form in FIG. 2.

As shown at block 22, a securing assembly, such as that described with respect to FIG. 1, is obtained having an elongate body portion configured to be formed into different maintainable shapes.

As shown at block 24, the elongate body portion is formed with respect to a part of the at least one limb to thereby cause the securing assembly to be maintained on the limb(s), As shown at block 26, the securing assembly and an implement are operatively engaged to thereby cause the implement to be supported in at least one working position.

As shown at block 28, with the implement supported in the one working position, the person can move his or her at least one limb to cause the implement to perform a task.

Exemplary forms of the securing assembly 10 will now be described with respect to FIGS. 3-14 as used to practice the inventive method, shown in flow diagram form in FIG. 2. It should be emphasized again that the exemplary form of the securing assembly 10, as well as the specific different manners of using the same, should not be viewed as limiting.

The exemplary securing assembly 10 has a bendable metal core 20 embedded within a surrounding cushioning layer 30. The cushioning layer 30 is made from a rubber-like material, The core 20 has a diameter D with the cushioning layer having a diameter D1. In one exemplary form, the diameter D is on the order of 1/16 of an inch, with the diameter D1 being on the order of ¼ inch. These diameters may be significantly different—larger or smaller—than described.

The outer surface 32 of the cushioning layer 30 is defined by circumferentially spaced ribs 34 that produce a textured outer surface shape that facilitates gripping against a person's skin without being abrasive.

Rounded caps 36 (one shown) are provided to prevent exposure to the harder core 20 at the ends of the elongate body portion 18.

In FIG. 4, the exemplary securing assembly 10 is shown with the elongate body portion 18 formed by being bent around a limb 14, in this case having spaced turns collectively wrapping through approximately 720° around the limb 14 to stably maintain the securing assembly 10 on the limb 14. The limb 14 is shown in FIG. 4 alternatively as a hand 14*a*, head 14*b*, arm 14*c*, leg 14*d*. torso 14*e*, finger 14*f*, etc. The degree of encircling of the portion of the limb 14 is not critical and may vary on a case by case basis. Commonly, the elongate body portion 18 will wrap at least 540° around the limb 14. A significantly larger number of turns may be formed for purposes of increasing holding forces and stability with turns wrapping around one or more limbs 14.

In FIG. 4, an end region 38 of the elongate body portion 18 is doubled back on itself to produce a receptacle 40 into which a part 42 of the implement 12 can extend with the implement 12 and securing assembly 10 operatively engaged.

As an alternative to using the elongate body portion 18 to define the receptacle 40, a fitting 44 may be attached to the elongate body portion 18', shown schematically in FIG. 5, to define a corresponding receptacle 40'.

As noted above, the implement 12 can take virtually an unlimited number of different forms. Exemplary forms are shown schematically in FIG. 6 in the form of a knife 12*a*, a fork 12*b*, a spoon 12*c*, a brush 12*d*, a pointer 12*e*, writing implement 12*f*, etc. These are but exemplary specific forms of implements that might be supported in a working position when practicing the inventive method. As noted above, virtually any portable implement that can be supported in at least one working position relative to at least one limb of a person, and that is movable with that limb(s) to perform a task, is contemplated by the invention.

There is no specific limitation as to how the securing assembly 10 and implement 12 are operatively engaged to thereby cause the implement to be supported in at least one of potentially a plurality of different working positions.

As shown in FIG. 4, the elongate body portion 18 might be spirally wrapped in a separated state independently of the particular limb upon which it will be maintained. For example, the configuration in FIG. 4 might be arrived at whereby extension of a limb 14 through the space bounded by the coiled elongate body portion 18 causes an expansion thereof to grippingly engage the limb 14.

Figure 7:
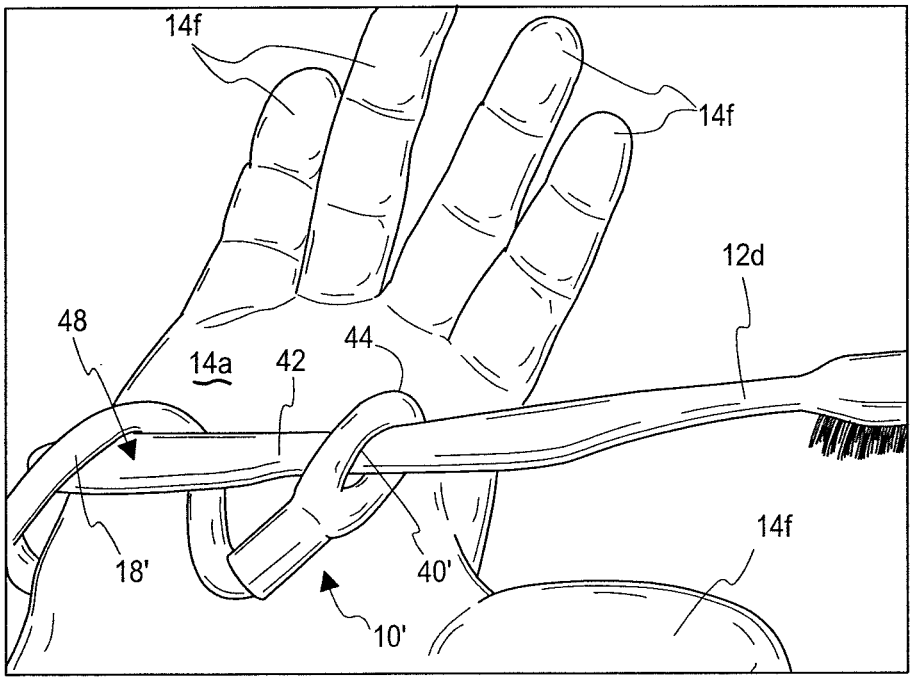
FIG. 7 is a bottom view of a hand with the inventive securing assembly operatively engaged with a toothbrush to cause the toothbrush to be supported in a working position thereon.
Figure 8:
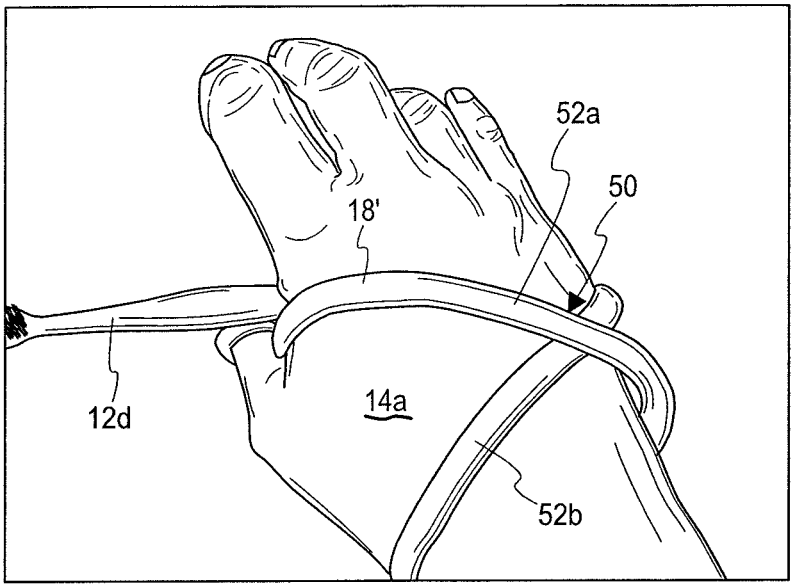
FIG. 8 is a view as in FIG. 7 but from a different perspective.

In FIGS. 7 and 8, a toothbrush 12*d* is shown in a working position on a person's hand 14*a*. The toothbrush 12*d* has a graspable handle/part 42 that is directed through the opening 40' on the fitting 44. The elongate body portion 18', extending away from the fitting 44, wraps through in excess of 180° around the proximal end region 48 of the handle/part 42 and is wrapped around the hand producing an "X" shape at the back of the hand, as seen at 50 in FIG. 8. Accordingly, the hand 14*a* is effectively gripped by crossing loops 52*a*, 52*b*. The length of the elongate body portion 18' wrapping around the proximal end region 48 tends to draw the proximal end region 48 of the toothbrush 12*d* and the fitting 40' against the inside region of the hand, which at the same time causes the handle/part 42 to wedge in the fitting receptacle 40'.

Alternatively, the stabilized length of the elongate body portion 18 may support the proximal end region 48 of the toothbrush 12*d* and fitting 44 in proximity to the inside region of the hand 14*a* whereby the user's finger(s) 14*f* can be repositioned to stabilize the proximal end region 48 and fitting 44 against the inside of the hand 14*a*.

Accordingly, the securing assembly 10' is primarily responsible for suspending the toothbrush 12*d* in the working position shown. The stability of this working position can be augmented by the movable portions of the person's hand 14*a* and/or fingers 14*f*, if possible.

Figure 9:
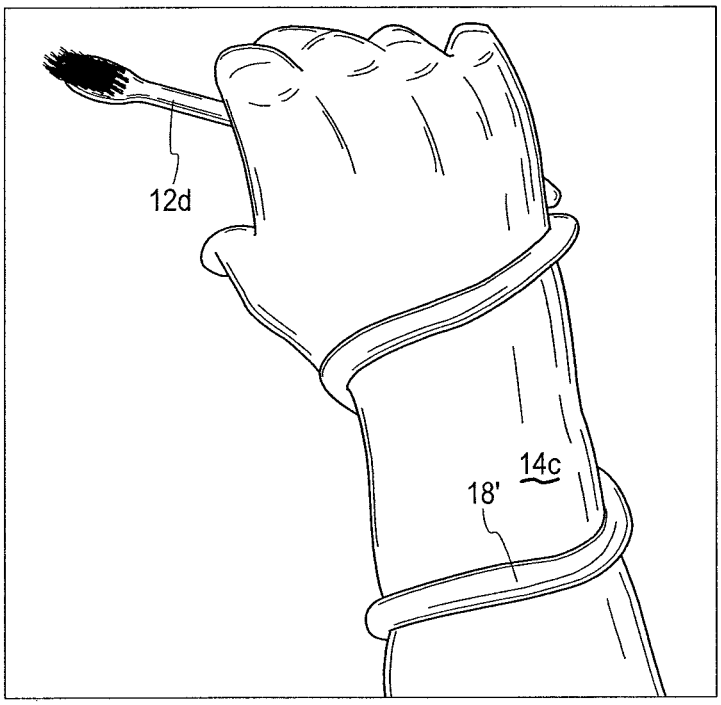
FIG. 9 is a view of a hand as in FIG. 8 wherein the elongate body portion on the securing assembly is wrapped in a different manner with respect to a person's hand and arm.

In an alternative arrangement as shown in FIG. 9, the elongate body portion 18', projecting away from the underside of the hand as in FIG. 7, can be wrapped around the user's arm 14*c* in the wrist region thereon to effect stabilization of a base for the toothbrush 12*d* in its working position.

Figure 10:
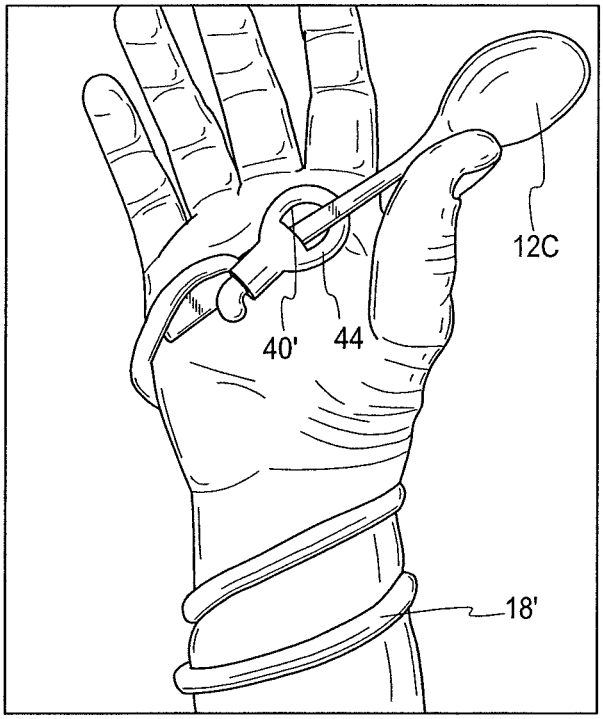
FIG. 10 is a view of a hand as in FIG. 7 with a spoon being supported in a working position.

FIG. 10 is a view, similar to that in FIG. 7, with a spoon 12*c* in a corresponding working position and with the elongate body portion 18' wrapped as in FIG. 9 with the spoon 12*c* extending through the receptacle 40' defined by the fitting 44.

Figure 11:
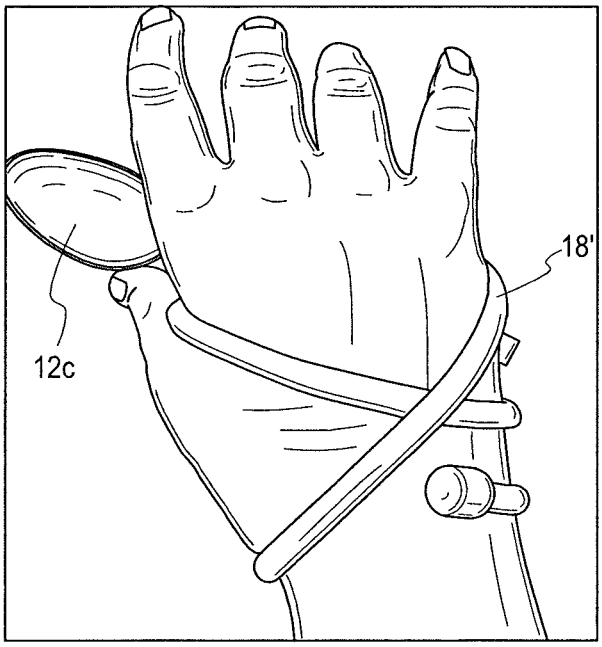
FIG. 11 is a view of a hand as in FIG. 8 with the spoon in FIG. 10 in a working position and the elongate body portion formed as in FIG. 8.

FIG. 11 corresponds to FIG. 8 with the spoon 12*c* in the working position of FIG. 10 and the elongate body portion 18' wrapped as in FIG. 8.

Figure 12:
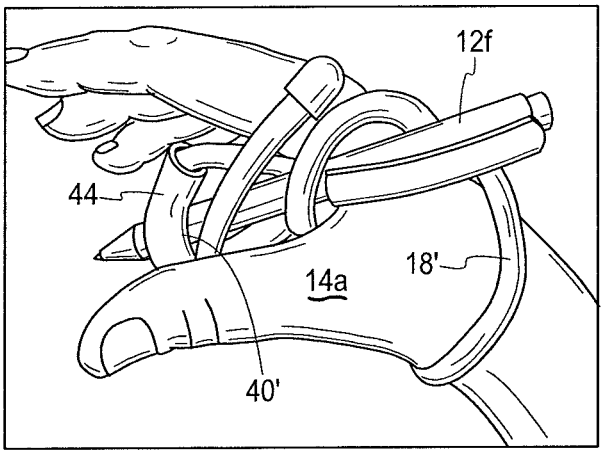
FIG. 12 shows a writing instrument operatively engaged with the inventive security assembly and in one representative working position.
Figure 13:
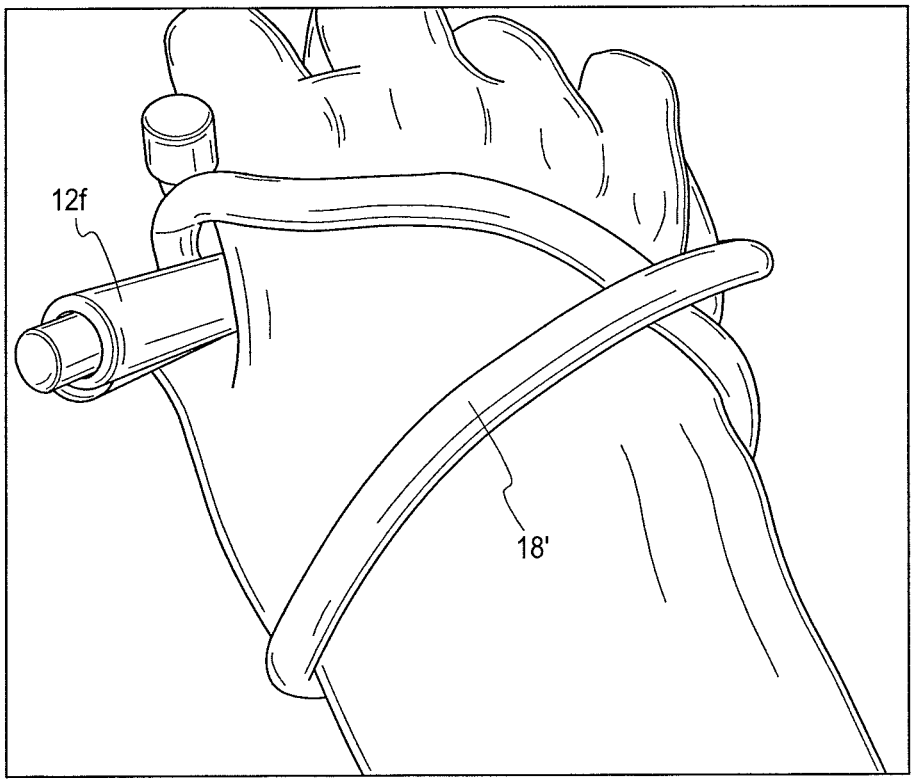
FIG. 13 is a view as in FIG. 12 from a different perspective.

In FIGS. 12 and 13 a writing instrument 12*f* is shown supported in the working position through the elongate body portion 18'. The writing instrument 12*f* projects through the receptacle 40' in the fitting 44 with the elongate body portion 18' wrapped around the barrel of the writing instrument 12*f* and a user's hand 14*a* in a pattern similar to that in FIG. 8.

The specific forming patterns for the elongate body portion 18 described above are only exemplary, as the elongate body portion 18, 18' may be formed typically by bending in virtually an unlimited number of different patterns around the particular implement 12 and any one or more limbs 14.

Any number of turns or change in direction of routing of the elongate body portion 18, 18' around the implements 12 and limbs 14 are contemplated. For example, the elongate body portion 18, 18' might be wrapped multiple times around a particular limb 14, woven between limbs, such as the fingers 14*f*, etc., to securely support the particular implement 14 in its desired working position.

Given the ability to shape the elongate body portion 18, 18' as desired, the implement 12 can be maintained in a plurality of different working positions by appropriately forming the elongate body portion 18, 18' with respect to the implement 12 and limb(s) 14. These working positions may involve capturing portions of the implement against the limb(s), as shown, for example, for the writing instrument

12*f* on the hand 14*a* in FIG. 12. The captive arrangement may be produced by the elongate body portion 18, 18' alone or may result from a person's manipulation of limb(s), such as the fingers 14*f* to effect grasping.

The implement 12 may be held in a "floating" working position supported by only elongate body portion 18, 18'.

Alternatively, as shown in FIG. 7, the implement 12*d* may cantilever away from the fitting 44 to be supported primarily by the securing assembly 10' where it is engaged thereby and braced/stabilized against the hand without having a significantly augmented holding force generated directly by the user's limb.

As noted above, the elongate body portion 18 may be partially or fully pre-formed before engaging the particular limb. Alternatively, the elongate body portion 18 can be substantially fully formed, as by bending portions thereof directly against and around limb contours.

While not required, in each variation described above, a part of the implement 12 projects in cantilever fashion away from the elongate body portion 18, and in most cases the fitting 44 thereon. However, another implement may be utilized wherein this cantilever support is not desirable or preferred.

Figure 14:
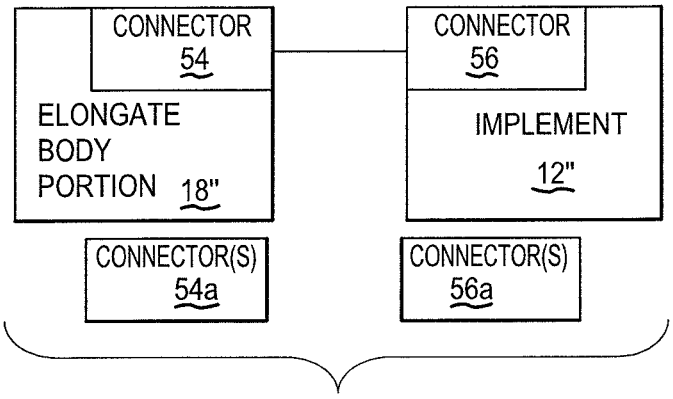
FIG. 14 is a schematic representation of an alternative form of elongate body portion, according to the present invention, and utilizing cooperating connectors between the elongate body portion and an implement.

In another form, as shown schematically in FIG. 14, the elongate body portion 18" has an associated connector 54 that is engageable with a connector 56 on the implement 12". The connector 54 may be integrally formed with the elongate body portion 18", fixedly connected thereto, or connected thereto so as to be replaceable and exchangeable as with another connector 54*a* having a different construction and capability.

Likewise, the connector 56 may be integrally formed with the implement 12", may be fixedly connected thereto, or may be releasably connectable to allow interchanging of the connector 56 with one or more similar connectors 56*a*.

As just an example, the connectors 54, 56 may be threaded connections, ones maintained by magnetic forces, etc.

With this arrangement, it may be possible to form the elongate body portion 18" with respect to a particular limb to maintain the same on the limb whereupon a selected implement 12" can be releasably joined. Serial connection of implements 12" of different construction can potentially take place.

The ability to interchange connectors 54, 54*a*; 56, 56*a* allows different connecting capabilities, including orientation, type of implement, stability of support, etc.

Typically, the implement will have a working portion that projects in cantilever fashion away from the particular connector 54, 54*a*, although this is not a requirement.

It is contemplated that the fitting 44 may perform as the connector 54, 54*a* and may by itself support the implement independently of the limb upon which it is placed in a working position.

It is also contemplated that a securing assembly may have a dedicated function. For example, a single implement may be permanently connected to an elongate body portion.

The foregoing disclosure of specific embodiments is intended to be illustrative of the broad concepts comprehended by the invention.

The invention claimed is:

1. A method of supporting an implement, configured to perform a task, in at least one working position on an arm of a person, the method comprising the steps of:

obtaining a securing assembly comprising an elongate body portion configured to be formed into different maintainable shapes, wherein the elongate body portion on the securing assembly comprises a shape retentive bendable core and a cushioning layer surrounding the shape retentive bendable core;

forming the elongate body portion against the person's arm including by wrapping a length of the elongate body portion against a back side of a hand on the person's arm and an inside region on the person's hand to thereby cause the securing assembly to be stably maintained on the person's arm with the elongate body portion in a selected shape, wherein a length of the elongate body portion extends through at least 360° around the person's hand; and operatively engaging the securing assembly and implement to thereby cause the implement to be stably supported on the person's arm in the one working position, whereby with the implement supported in the one working position, the person can move his/her arm to cause the implement to perform the task for which the implement is configured.

2. The method of supporting an implement in at least one working position on an arm of a person according to claim 1 wherein the securing assembly comprises a receptacle into which a part of the implement extends with the implement and securing assembly operatively engaged.

3. The method of supporting an implement in at least one working position an arm of a person according to claim 1 wherein a part of the implement is captured between the elongate body portion and the person's arm with the implement and securing assembly operative engaged.

4. The method of supporting an implement in at least one working position on an arm of a person according to claim 1 wherein with the implement supported in the one working position, the elongate body portion wraps through at least 540° around the person's arm.

5. The method of supporting an implement in at least one working position on an arm of a person according to claim 1 wherein the step of forming the elongate body portion against the person's arm comprises bending the elongate body portion before operatively engaging the securing assembly and implement.

6. The method of supporting an implement in at least one working position on an arm of a person according to claim 1 wherein with the implement supported in the one working position, a leading portion of the implement projects in cantilever fashion away from the securing assembly.

7. The method of supporting an implement in at least one working position on an arm of a person according to claim 1 wherein with the implement supported in the one working position, a leading portion of the implement projects in cantilever fashion away from a connector on the securing assembly.

8. The method of supporting an implement in at least one working position on an arm of a person according to claim 7 wherein the connector on the securing assembly defines a receptacle for a part of the implement.

9. The method of supporting an implement in at least one working position on an arm of a person according to claim 8 wherein the step of operatively engaging the securing assembly and implement comprises causing the part of the implement to become wedged in the receptacle for the part of the implement.

10. The method of supporting an implement in at least one working position on an arm of a person according to claim 1 wherein the implement has a working end that performs as one of: a) a knife; b) a fork; c) a spoon; d) a brush; and e) a pointer.

11. The method of supporting an implement in at least one working position on an arm of a person according to claim 7 wherein the connector on the securing assembly engages a part of the implement to maintain the implement in an operative position with respect to the securing assembly independently of the person's arm.

12. The method of supporting an implement in at least one working position on an arm of a person according to claim 7 wherein the connector on the securing assembly cooperates with at least one connector on the implement to maintain the implement in an operative position with respect to the securing assembly independently of the persons arm.

13. The method of supporting an implement in at least one working position on an arm of a person according to claim 11 wherein the implement is placed in the operative position with respect to the securing assembly before forming the elongate body portion by bending the elongate body portion against the part of the person's arm.

14. The method of supporting an implement in at least one working position on an arm of a person according to claim 1 wherein the shape retentive bendable core is made from metal.

15. A method of supporting an implement in at least one working position on an arm of a person, the method comprising the steps of:

obtaining an implement configured to perform a task;

obtaining a securing assembly comprising an elongate body portion configured to be formed into different maintainable shapes, the elongate body portion having a free end, wherein the elongate body portion on the securing assembly comprises a shape retentive bendable core and a cushioning layer surrounding the shape retentive bendable core;

forming the elongate body portion against the person's arm including by wrapping a length of the elongate body portion against a back side of a hand on the person's arm and an inside region on the person's hand, so that the free end of the elongate body portion is at the inside region of the user's hand, to thereby cause the securing assembly to be stably maintained on the person's arm with the elongate body portion in a selected shape; and operatively engaging the securing assembly and implement to thereby cause the implement to be stably supported on the person's arm in the one working position, whereby with the implement supported in the one working position, the person can move his/her arm to cause the implement to perform the task for which the implement is configured.

16. A method of supporting an implement in at least one working position on an arm of a person, the method comprising the steps of:

obtaining an implement configured to perform a task;

obtaining a securing assembly comprising an elongate body portion configured to be formed into different maintainable shapes, wherein the elongate body portion on the securing assembly comprises a shape retentive bendable core and a cushioning layer surrounding the shape retentive bendable core;

forming the elongate body portion against the person's arm including by wrapping a length of the elongate body portion against a back side of a hand on the person's arm and an inside region on the person's hand to thereby cause the securing assembly to be stably maintained on the person's arm with the elongate body portion in a selected shape; and operatively engaging the securing assembly and implement to thereby cause the implement to be stably supported on the person's arm in the one working position including by wrapping a length of the elongate body portion through in excess of 180°0 around a part of the implement, whereby with the implement supported in the one working position, the person can move his/her arm to cause the implement to perform the task for which the implement is configured.

17. The method of supporting an implement in at least one working position on an arm of a person according to claim 15 wherein with the implement supported in the one working position, the elongate body portion wraps through at least 360° around the person's hand.

* * * * *